US006419544B1

(12) United States Patent
Parker et al.

(10) Patent No.: US 6,419,544 B1
(45) Date of Patent: Jul. 16, 2002

(54) BATTERY POWERED GYROSCOPIC ENTERTAINMENT DEVICE AND SYSTEM

(75) Inventors: Andrew Parker, Sausalito; Edward C. McKinney, San Rafael; Charles E. Taylor, Sebastopol; Richard J. Thalheimer, San Francisco, all of CA (US)

(73) Assignee: Sharper Image Corporation, San Francisco, CA (US)

( * ) Notice: Subject to any disclaimer, the term of this patent is extended or adjusted under 35 U.S.C. 154(b) by 0 days.

(21) Appl. No.: 09/669,269

(22) Filed: Sep. 25, 2000

(51) Int. Cl.[7] ..... A63H 1/00
(52) U.S. Cl. ..... 446/233; 446/236; 446/238
(58) Field of Search ..... 446/233, 234, 446/235, 236, 239, 242, 266; D21/131, 460, 455, 457

(56) References Cited

U.S. PATENT DOCUMENTS 5,439,408 A * 8/1995 Wilkinson ..... 446/409
5,683,284 A * 11/1997 Christen ..... 446/233
5,823,845 A * 10/1998 O'Berrigan ..... 446/234
D413,335 S 8/1999 Pinchuk ..... D14/299
D414,190 S 9/1999 Pinchuk ..... D14/299
D447,523 S * 9/2001 Christianson ..... D21/460

* cited by examiner

*Primary Examiner*—Jessica Harrison
*Assistant Examiner*—Alex F. R. P. Rada, II
(74) *Attorney, Agent, or Firm*—Fliesler, Dubb, Meyer & Lovejoy LLP

(57) ABSTRACT

A battery operated gyroscopic entertainment device is powered from a mating cradle, or from a battery supply within the device. The device includes an egg-shaped housing in which is disposed a high speed DC motor whose motor shaft preferably extends from each end of the motor. A hub member is attached to each shaft end, and a weighted belt is attached to each hub member. A central portion of the motor housing is fixedly attached to the device housing such that upon application of operating potential to the motor, the motor shaft, and the weighted hub members rotate at high speed, which imparts a gyroscopic action to the device. A cradle may be provided containing a power source, with power connections that mate to the device housing when the housing is placed within the cradle.

9 Claims, 3 Drawing Sheets

BATTERY POWERED GYROSCOPIC ENTERTAINMENT DEVICE AND SYSTEM

FIELD OF THE INVENTION

This invention relates to gyroscopic entertainment devices in general, and more specifically to a battery operated gyroscopic entertainment device and system.

BACKGROUND OF THE INVENTION

String-operated gyroscopic toys have long been known in the art. A gimbaled central mass within a top-like housing is made to rotate by wrapping string around mass and pulling rapidly. As the mass rotates, the toy exhibits gyroscopic properties, but typically only for a very short time, perhaps thirty seconds, before the string-imparted rotation ceases.

Rather sophisticated electronically powered gyroscopic devices are known for use as navigational aids, and are commonly found on aircraft. Understandably, such precision devices are expensive and somewhat bulky, when compared to a child's toy gyroscope.

What is needed is a gyroscopic entertainment device that can be battery operated and will exhibit gyroscopic action for longer time periods than stringpowered toy devices.

The present invention provides such a gyroscopic entertainment device and system for powering such device.

SUMMARY OF THE PRESENT INVENTION

The present invention provides a battery operated gyroscopic entertainment device and system for powering the device. In a first aspect, the device comprises a cradle that houses an electrical power source and provides a concave region into which the gyroscopic device can be inserted, and further comprises a somewhat egg-shaped gyroscopic device. The cradle concave region presents two voltage contacts that mate with two voltage pads on the perimeter of the gyroscope. A button on the cradle provides operating potential to the gyroscope when placed in the cradle, whereupon a motor within the gyroscope begins to rotate at high RPM. The motor shaft preferably extends from each end of the motor housing, and a donut-shaped weight is attached to a light weight element attached to each end of the motor shaft. The motor housing is attached within a donut-shaped member that joins to gyroscope housing.

The gyroscope is left in the cradle for perhaps a minute, during which time the gyroscope motor is powered. The gyroscope is then removed from the cradle and may be placed on any hard surface where it will exhibit gyroscopic behavior for several minutes, until the motor rotation ceases. In an alternative embodiment, the invention comprises only the gyroscopic device, which also houses an internal battery supply.

Other features and advantages of the invention will appear from the following description in which the preferred embodiments have been set forth in detail, in conjunction with the accompanying drawings

DETAILED DESCRIPTION OF THE PREFERRED EMBODIMENT

Figure 1:
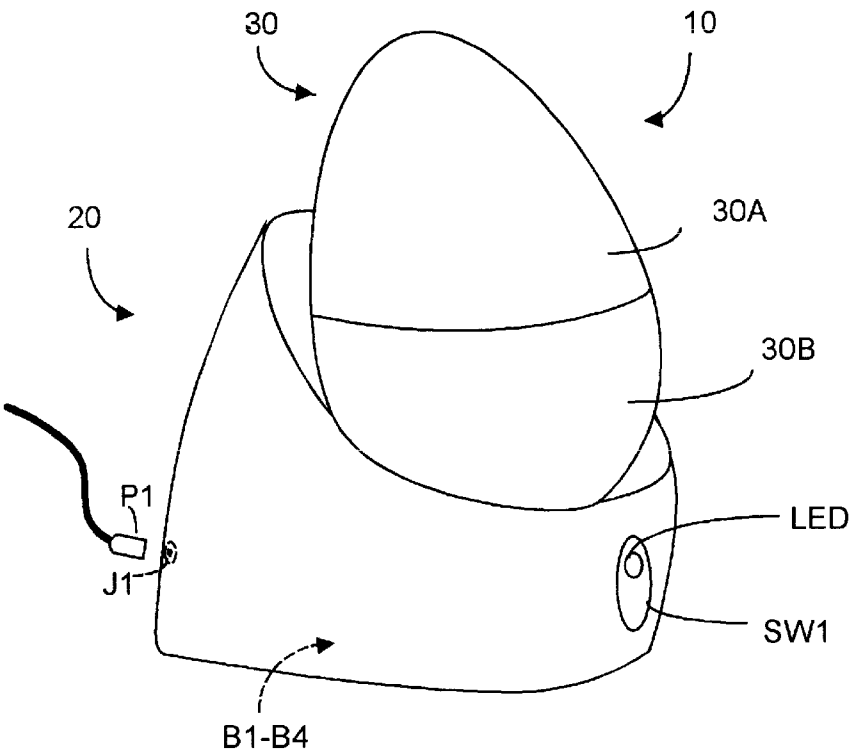
FIG. 1 is a perspective view of a system comprising a battery-operated gyroscopic device and a power-supply providing cradle, according to the present invention.

FIG. 1 depicts a somewhat egg-shaped gyroscopic device 10 placed within a cradle 20. Cradle 20 houses a battery power supply, e.g., four 1.5 VDC cells B1–B4, and/or includes a power-receiving jack J1 to which an external source of DC operating potential may be input via a plug P1. As will be described with respect to FIG. 3A, within the concave region of cradle 20 into which device 10 fits there is mounted a pair of power providing pads that mate with a pair of power-receiving pads disposed on housing 30 of device 10 (see FIG. 3B). A switch SW1 on cradle 20 is pressed by a user to cause power from the cradle to be provided to device 10, specially to a DC motor housed within device 10. A light indicator LED is provided to show when power is being provided.

Figure 2:
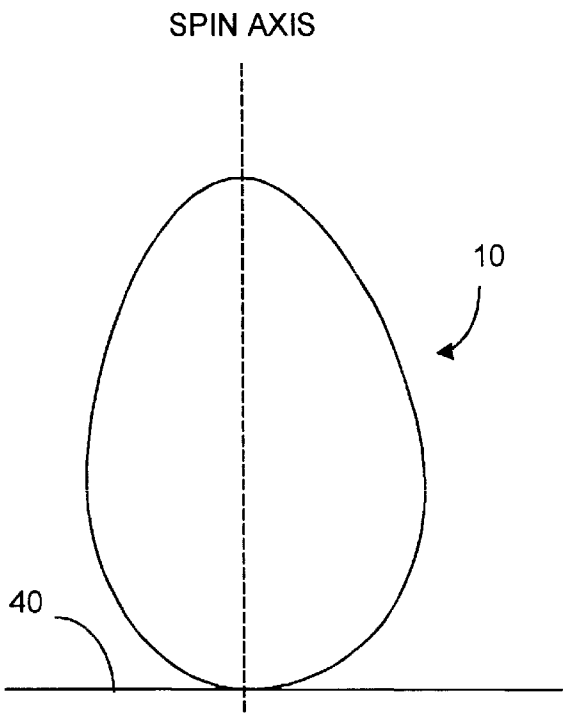
FIG. 2 is a view of the energized gyroscopic device exhibiting gyroscopic action when placed on a surface, according to the present invention.

When power is provided by cradle 20 to device 10, the motor and associated weights (to be described) within device 10 begin to rotate rapidly. After a charge period that may be a minute or so, the motor and weights within device 10 are rotating rapidly, whereupon a user removes device 10 and places it upon a surface 40. As indicated in FIG. 2, gyroscopic action resulting from high speed rotation of the weights within device 10 will cause device 10 to rotate about a spin axis, and to right itself back to the spin axis if disturbed.

Figure 3B:
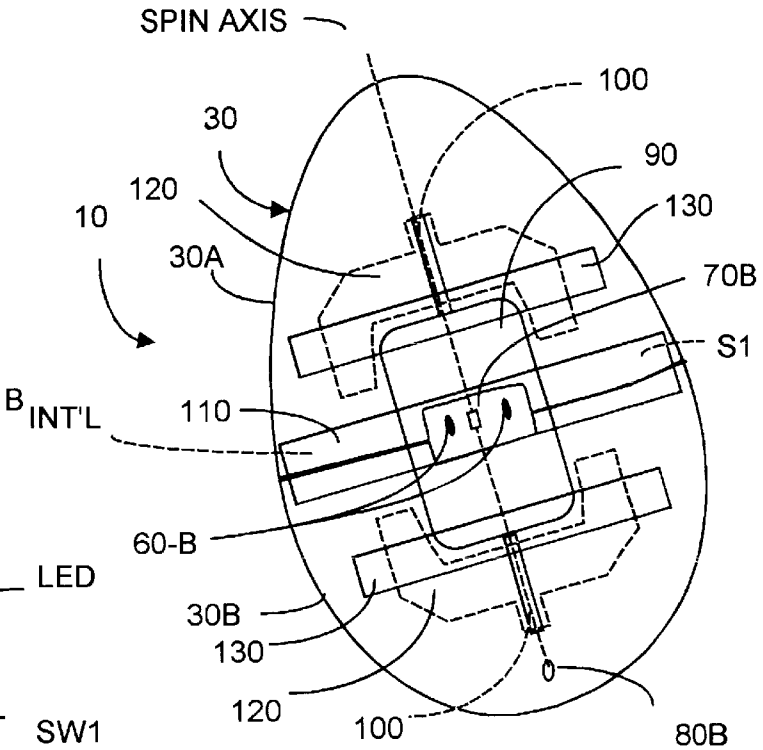
FIG. 3B is a perspective view showing the gyroscopic device of FIG. 1, according to the present invention.
Figure 3A:
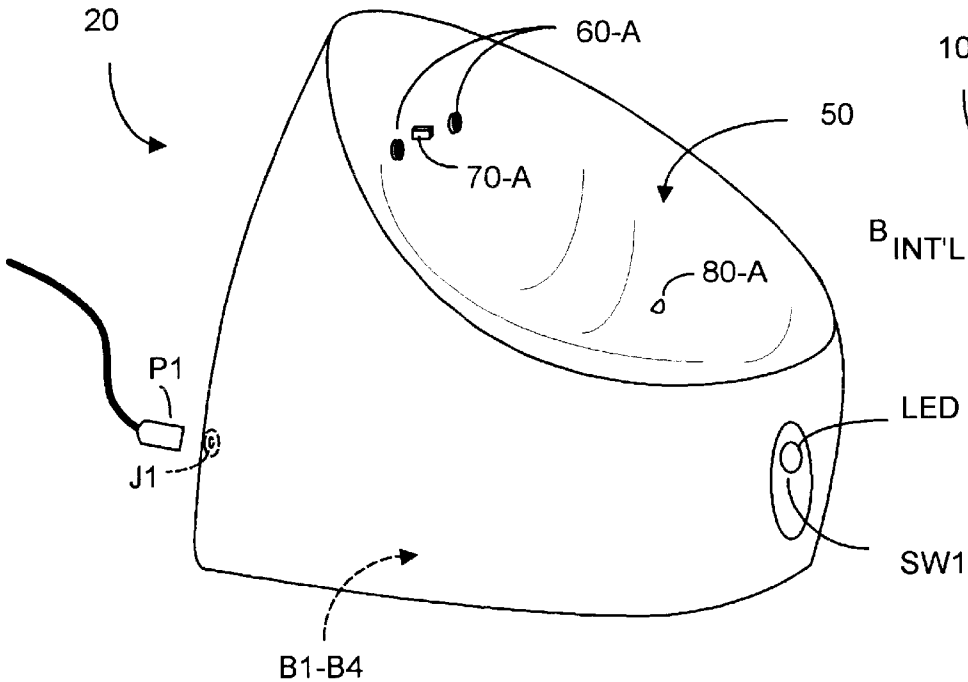
FIG. 3A is perspective view showing the cradle of FIG. 1, according to the present invention.
Figure 4:
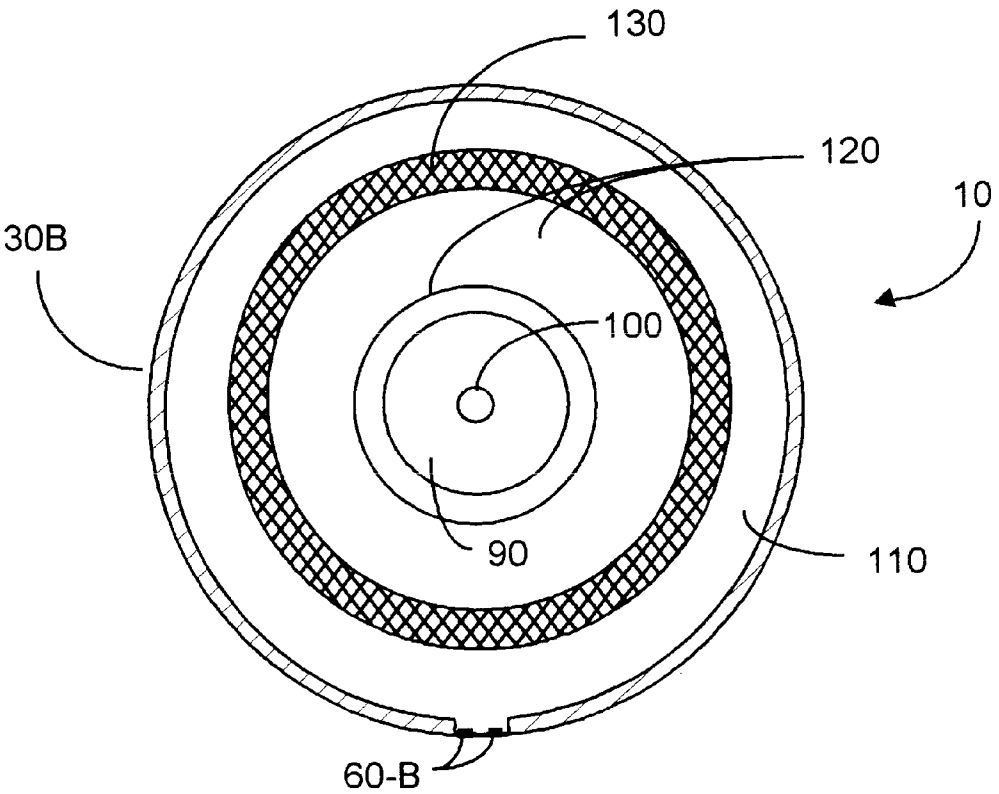
FIG. 4 is a top view of the device of FIG. 1 with the upper housing portion removed for clarity, according to the present invention.

Turning now to FIG. 3A, concave region 50 of cradle 20 includes a pair of power providing connectors 60A spaced-apart with an alignment projection 70-A preferably disposed between these connectors. When SW1 is toggled on by a user, DC potential from internal battery power source B1–B4, or from external source received via J1 is present at these two connectors. A projecting lug 80-A is also provided on the surface of the concave region to aid in aligning and retaining device 10 when it is inserted into cradle 20.

FIG. 3B shows device 10 as though its housing 30 were transparent, which in fact it may be, e.g., a transparent or semi-transparent durable plastic. Egg-shaped housing 30 preferably comprises an upper portion 30A and a lower portion 30B, that are adhesively attached together. The interface between sections 30A and 30B provides a window region whereas mating electrical pads 60B and a recess 70B are provided. The spaced-apart distance between pads 60-B matches the spaced-apart distance between pads 70-A on cradle 20. Further, projection 70-A on cradle 20 is sized to align and fit within recess 70B on device 10. In FIG. 3B it is understood that device 10 will be rotated clockwise perhaps 90° before being inserted into cradle 20. When so rotated, there will be mating alignment between elements 70-A and 70-B, between pads 60-A and 60-B, and further between projection 80-A on cradle 20 and dimple-like recess 80-B on device 10.

Within device 10, pads 70-B are electrically connected to the winding on motor 90. Motor 90 has a shaft 100 that preferably extends from both ends of the motor. Motor 90 preferably is a high speed unit able to rotate at perhaps 10,000 RPM to 15,000 RPM when 6 VDC or higher is coupled to the motor windings. In cross-section, motor 90 is about 23 mm in diameter.

At its equator, the housing of motor 90 is fixedly attached to a donut-shaped member 110, to which are attached pads

60-B, and in which is formed recess 70-B. Member 110 has a top-to-bottom thickness of perhaps 10 mm and an outer diameter of perhaps 70 mm, and may be made of plastic, nylon, or other suitable materia, preferably an injection moldable material.

As shown in FIG. 3A, fixedly attached to the upper portion and to the lower portion of shaft 100 is a preferably light weight plastic hub-shaped or bell-shaped member 120 that has an outer diameter of perhaps 30 mm. Fixedly attached to each member 120 is a ring-shaped or belt-shaped weight 130 preferably made of metal, brass for example. An exemplary weight for each unit 130 is perhaps two ounces. Note that the radius of member 120 (measured from the spin axis) imparts a greater moment to the effective mass of the weights 130.

Typically, each weight 130 is perhaps 10 mm in thickness, measured top-to-bottom, and is perhaps 5 mm thick. When operating potential is coupled to the winding of motor 90, motor shaft 100 rotates, which rotates both members 120, causing rotation of the upper and lower weights 130, all rotation occurring about the spin axis of device 10. Member 110 does not, of course, rotate, in that it is fixedly attached to the motor housing, and is also secured to housing 30. Thus, rotation of weights 130 occurs solely within housing 30, during and for a time after application of operating potential via pads 60-B.

If desired, as indicated in FIG. 3B, an internal battery supply, denoted $B_{INTL}$, may be disposed within housing 30 such that cradle 20 can be dispensed with. A switch S1, associated with the internal battery, would be accessible from housing 30 to enable a user to power-on motor 90. Switch 1 could be a push-button switch that causes the motor to be energized only as long as S1 is depressed, or a toggle-type switch that provides an option to be activated to cause motor 90 to remain activated until the switch is again touched by the user. In this latter mode, device 10 could remain functional for as long as battery life remains, although of course device 10 could hit an object and topple over in its gyroscopic movement.

In summary, the present invention provides a gyroscopic device that can entertain for substantially longer periods of time than can old fashioned pull-the-string type gyroscopic devices.

Modifications and variations may be made to the disclosed embodiments without departing from the subject and spirit of the invention as defined by the following claims.

What is claimed is:

1. A gyroscopic device system, comprising:

a cradle, defining a concave region sized to accept at least a portion of said gyroscopic device, said concave region including first and second power supply providing terminals; and a gyroscopic device, including:

a housing;

a motor disposed within said housing, including a motor shaft that defines a spin axis and rotates when power is provided to said motor;

a weight attached with said motor shaft, said weight being symmetrical about said spin axis; and a first and second power supply receiving terminal mounted on said housing, for providing operating potential to said motor when said gyroscopic device is placed within said concave region of said cradle.

2. The system of claim 1, wherein said shaft of said motor extends from each end of said motor.

3. The system of claim 2, wherein said weight is affixed to said shaft by a bell-shaped member that is mounted on each end of said shaft, said member rotates about said spin axis when said motor rotates.

4. The system of claim 1, wherein said shaft of said motor rotates at from about 5,000 RPM to about 15,000 RPM.

5. The system of claim 1, wherein said cradle provides said operating potential to said motor when said motor is placed in said cradle.

6. The system of claim 1, wherein said cradle further includes a battery power supply; and wherein said housing of said device includes mating supply pads, coupled to said motor, disposed to mate with said first and second power supply providing terminals when said device is placed in said cradle.

7. The system of claim 1, wherein said housing is egg-shaped.

8. The system of claim 1, further including means for retaining said device in alignment within said cradle.

9. A gyroscopic device, comprising:

a housing;

a motor disposed within said housing, including a shaft having a first end and a second end protruding outward from said motor and defining a spin axis, said shaft rotates upon application of operating potential to said motor;

a weight symmetrically attached about said spin axis to said first end of said shaft; and an external cradle to which said housing is seated upon to apply operating potential to said motor.

* * * * *